United States Patent [19]

Tateno

[11] 4,346,542

[45] Aug. 31, 1982

[54] JOINT FOR USE IN CONCRETE DEPOSIT

[76] Inventor: Kohkichi Tateno, No. 39-21, Zenpukuji 2-Chome, Suginami-ku, Tokyo, Japan

[21] Appl. No.: 55,606

[22] Filed: Jul. 9, 1979

[51] Int. Cl.[3] ..... E01C 11/10; E04F 15/14

[52] U.S. Cl. ..... 52/396; 404/48; 404/68

[58] Field of Search ..... 404/48, 68; 52/396

[56] References Cited

U.S. PATENT DOCUMENTS

| | | | |
|---|---|---|---|
| 1,768,690 | 7/1930 | Huntington | 404/68 |
| 2,282,335 | 5/1942 | Methven | 404/48 |
| 2,405,844 | 8/1946 | Mortenson | 52/396 X |
| 3,912,286 | 10/1975 | Kerschner | 404/68 X |
| 4,050,206 | 9/1977 | Utsuyama | 52/396 |

FOREIGN PATENT DOCUMENTS

| | | | |
|---|---|---|---|
| 1534280 | 6/1969 | Fed. Rep. of Germany | 404/68 |
| 400215 | 4/1966 | Switzerland | 404/68 |

*Primary Examiner*—Alfred C. Perham
*Attorney, Agent, or Firm*—Jordan and Hamburg

[57] ABSTRACT

Joint used to prevent cracks from occurring in a concrete floor. The joint comprises a body of soft material such as foamed styrol and urethane, a capping member of synthetic resin arranged on the top of body, and leg members for supporting and positioning the body on which the capping member has been mounted at the time of the concrete deposit, said leg members being adjustable to raise or lower the body.

7 Claims, 49 Drawing Figures

Figure 1:
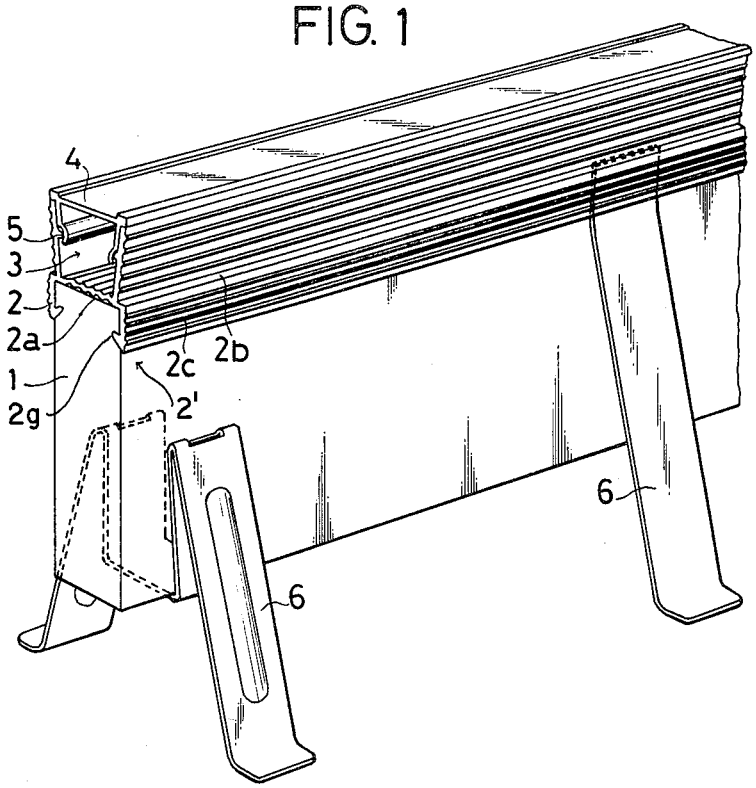

FIG. 17
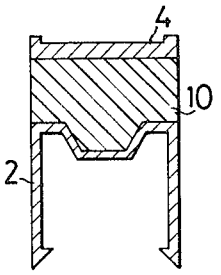
FIG. 18
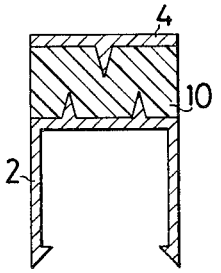
FIG. 19
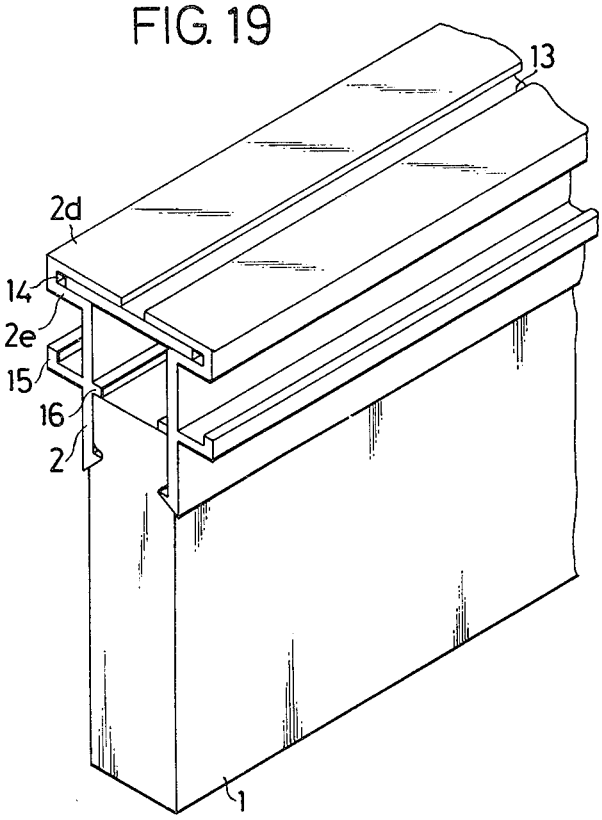
FIG. 20
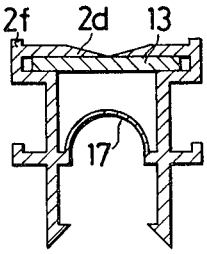
FIG. 21
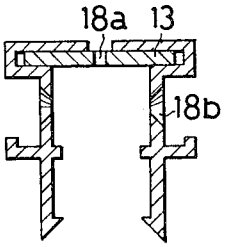
FIG. 22
FIG. 23
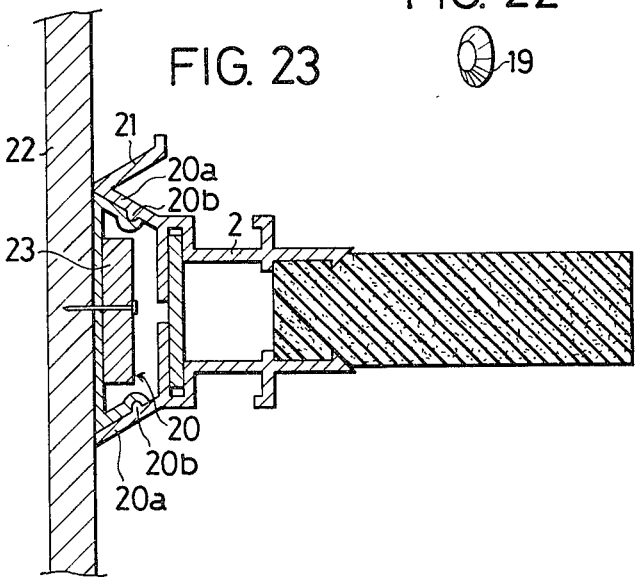

JOINT FOR USE IN CONCRETE DEPOSIT

The present invention relates to a joint used to prevent cracks from occurring in a concrete floor. The subject matter of the present invention is different from the joiner used between the pre-fabricated concrete plane blocks which are well known as one construction procedure, for example, the curtain wall procedure. The joiner is used to connect concrete plane blocks of a certain size to one another and to prevent rain and water from permeating therebetween. However, since the joiner is used between the concrete plane blocks each being prefabricated as a small unit, the joiner should be distinguished from the joint of the present invention which is used at the time of concrete deposition in a construction site.

An asphalt has been used as the conventional joint. Asphalt joint has been used in such a manner that an area in which concrete is to be deposited is framed by lumber plates and, concrete is poured thereinto. After hardening of concrete, the lumber plates are removed to leave spaces, into which melted asphalt is poured. The asphalt joint is not weather proof and is not suitable for use particularly at the place where the change in temperature is great. When concrete is expanded as temperature rises, asphalt is softened and squeezed out above the concrete surface, so that softened and squeezed asphalt adheres to wheel tires and shoes to be removed therewith, particularly when used in the street or plaza. In addition, when temperature changes from high to low, asphalt squeezed out from the space can not return enough to fill the spaces, thus causing the volume of asphalt to decrease further and further. And finally, recesses are formed at the portion of the asphalt joint and sand and dust enter the recesses. Weeds rooted in the sand are often seen blooming.

In order to eliminate the above-mentioned drawback, solid asphalt plates "Elastite" (trade name of Philipy Curray Co.) are used, but they can not be used satisfactorily and provide problems in the handling thereof in a construction site.

After being used with the lumber plates mounted on the top thereof, "Elastite" disappeared from the commercial market by the appearance of molded plates of foamed plastics. However, these molded plates of foamed plastics have such a problem that they can not resist the pressure caused at the time of concrete deposition because they are soft.

The present invention is intended to eliminate the above-mentioned drawbacks.

Accordingly, an object of the present invention is to provide a joint capable of preventing cracks from occurring in a concrete floor and being easily handled in a construction site.

Another object of the present invention is to provide a joint easily adjustable in the height thereof.

These and other objects of the present invention will be apparent from the following detailed description with reference to the accompanying drawings.

Figure 2:
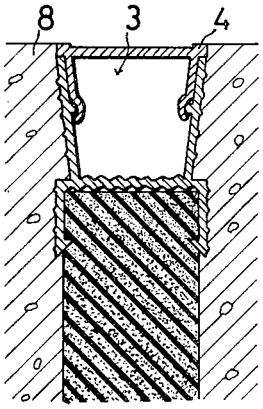
Figure 3:
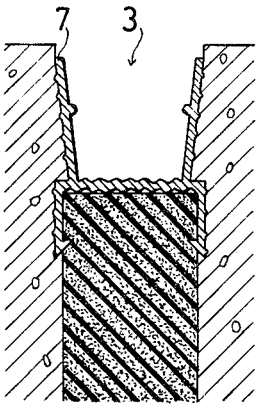
Figure 4:
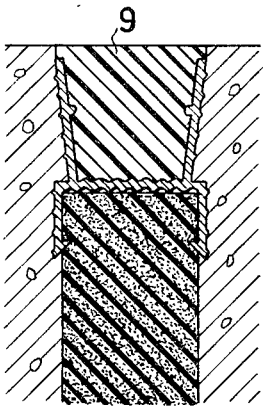
Figure 5:
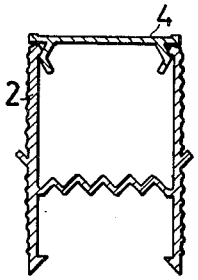
Figure 6:
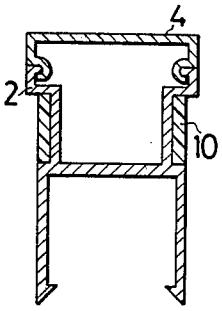
Figure 7:
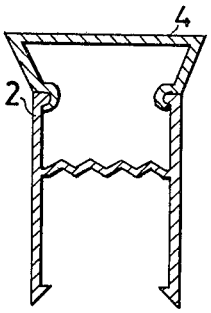
Figure 8:
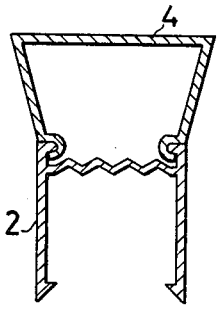
Figure 9:
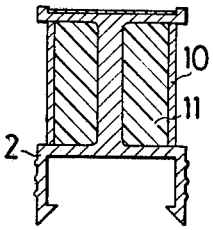
Figure 10:
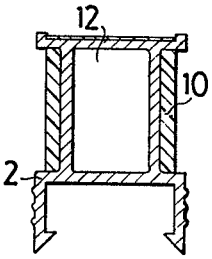
Figure 11:
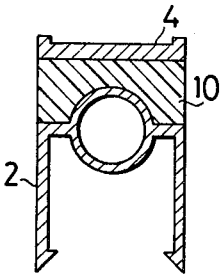
Figure 12:
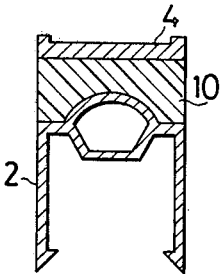
Figure 13:
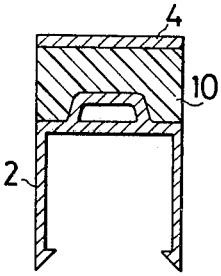
Figure 14:
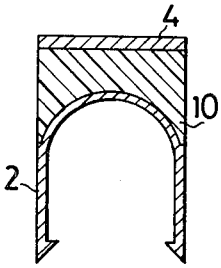
Figure 15:
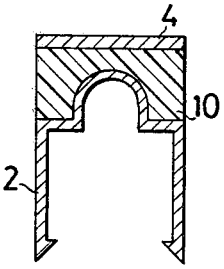
Figure 16:
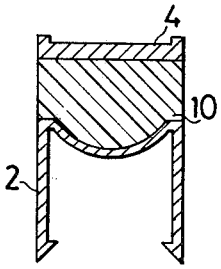
Figure 24:
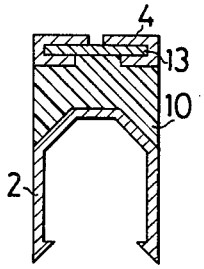
Figure 25:
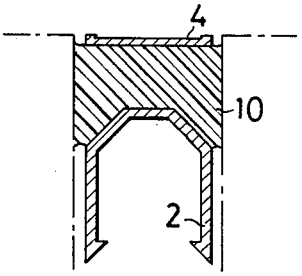
Figure 26:
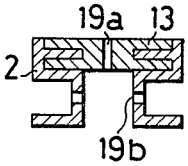
Figure 27:
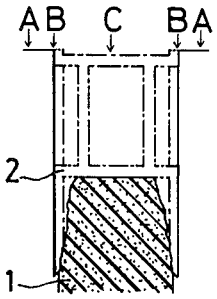
Figure 28:
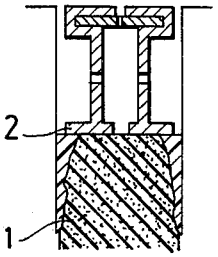
Figure 29:
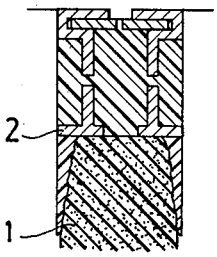
Figure 32:
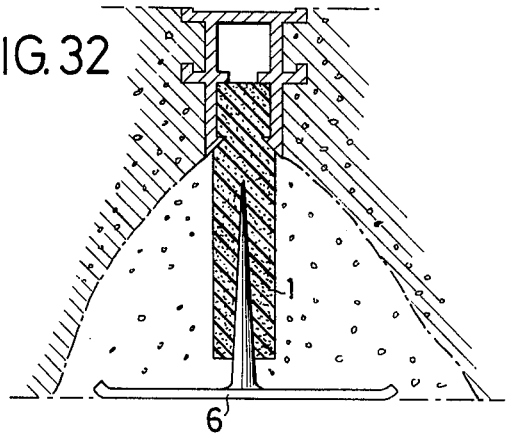
Figure 33:
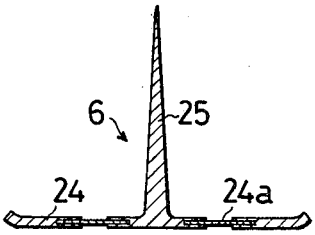
Figure 34:
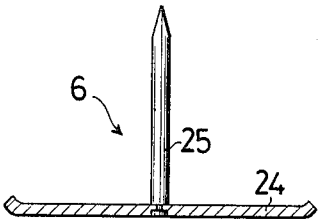
Figure 40:
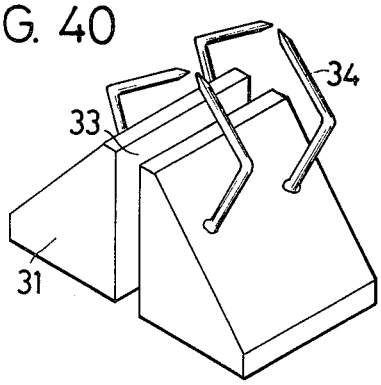
Figure 41:
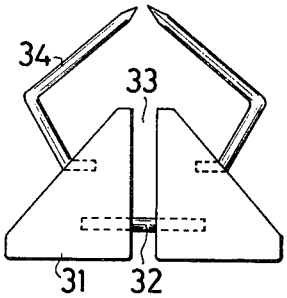
Figure 44:
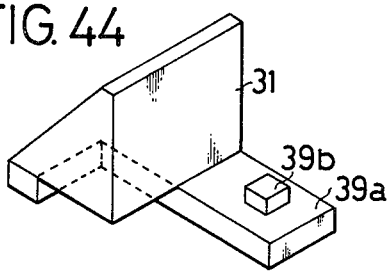
Figure 45:
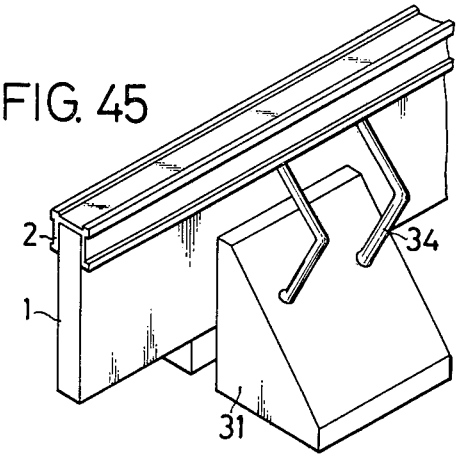
Figure 46:
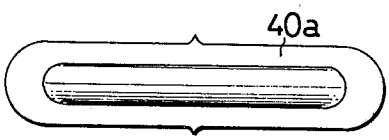
Figure 48:
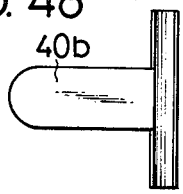
Figure 47:
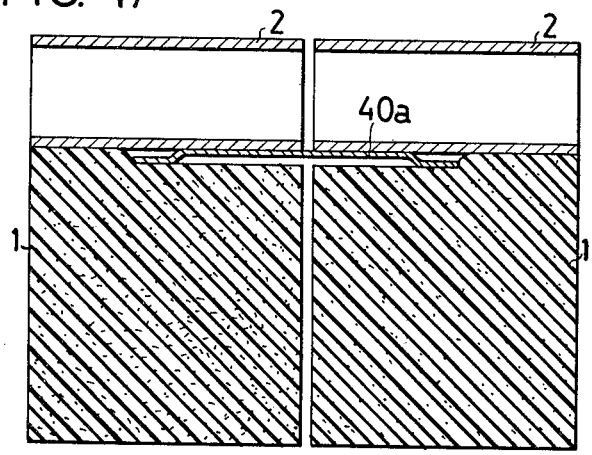
Figure 49:
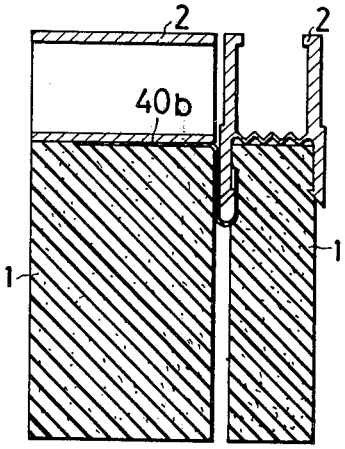

The drawings show typical embodiments of the present invention, in which:

FIG. 1 is an isometric view showing an example of a joint according to the present invention, FIGS. 2 through 4 are partial sectional views showing how the example shown in FIG. 1 is arranged at the time of concrete deposition, FIGS. 5 through 18 are sectional views showing other examples of the joint according to the present invention, FIGS. 19 through 23 show further improved examples of the joint according to the present invention, in which FIGS. 19 and 22 are isometric views and FIGS. 20, 21 and 23 are sectional views, FIG. 24 is a sectional view showing a further improved example of the joint according to the present invention, FIG. 25 is a sectional view of an example of the joint which is referred to when the example shown in FIG. 24 is explained, FIG. 26 is a sectional view showing an example of the joint according to the present invention which is used to repair the broken joint, FIGS. 27 through 29 are sectional views showing how the broken joint is repaired, FIGS. 30 through 45 show other examples of leg members for supporting and positioning the joint, in which FIGS. 30, 31, 35 through 40 and 42 through 45 are isometric views, FIGS. 32 through 34 are sectional views, and FIG. 41 is a front view, and FIGS. 46 through 49 show connecting members for connecting the joints to each other, in which FIGS. 46 and 48 are plan views and FIGS. 47 and 49 sectional views.

In FIG. 1, a joint comprises a body 1, which is a plate of a soft material such as foamed styrol, capping assembly including a capping member 2 of a synthetic resin or metal which is mounted on the top of the body 1, and a cap 4 on the capping member 2. There is provided in the lower portion 2' of the capping member 2 a recess of reversed U-shape, into which the plate 1 is fitted, and there are also provided at the lowermost ends of both sides of the recess claws **2*g* for fixing the inserted plate 1. The inserted plate 1 may be fixed to the capping member 2 using a binding agent. There is provided in the upper portion of the capping member 2 a U-shaped channel, into which asphalt or the like is poured as described later, said channel being covered by the cap 4 to prevent concrete from pouring into the channel at the time of concrete deposition. A shallow recess is formed on the surface of the cap 4 to allow the surface of concrete to be easily applied with a trowel. The capping member 2 and the cap 4 are connected each other by means of fastening means 5, which includes projections on the capping member 2 and concavities on the cap 4 to allow the cap 4 to be easily removed from the capping member 2. Instead of this fastening means 5, an adhesive or bonding agent may be used in such a manner that the cap 4 can be easily removed from the capping member 2. The cap 4 which is mounted on the top of the capping member 2 has a certain thickness. This causes the top of the capping member 2 to be positioned below the surface of a concrete floor to make the water-tightness of the joint and the finish of the concrete surface satifactory, when the cap 4 is removed from the capping member 2 after concrete deposition. A partition 2*a* of the capping member 2 is corrugated to provide good elasticity. The outer surface of the capping member 2 is provided with a stepped portion 2*b* and projections 2*c*, which serve to cause the outer surface of the capping member 2 to firmly contact the concrete. In order to make the water-tightness of the joint good, a water-tight material such as butyl rubber may be arranged on the stepped portion 2*b***.

Numeral 6 represents leg members for supporting the joint body 1 with the capping member 2 mounted thereon, one of which supports the joint body 1 holding the lower portion of the joint body 1 between two legs and the other of which supports the joint body 1 inserting the top of the leg between the capping member 2 and the plate 1. Both leg members can adjust the height of the joint by closing or opening both legs. Other leg members will be described later.

Referring to FIGS. 2 through 4, it will be described how the joint of the present invention is used and serves to function. The joints are arranged with a predetermined distance therebetween on a roughly deposited concrete surface, on which concrete is to be further deposited. Depending on how high concrete is to be deposited, the joints are adjusted in height by closing or opening the legs of the leg members to thereby level the top of both stepped sides of the cap 4 with the surface of a concrete floor 8 as shown in FIG. 2. It is preferable that the leg members are previously fixed by mortar or the like before concrete deposition in order to prevent the leg members from being moved at the time of concrete deposition. Because of the shallow recess formed on the top surface of the cap 4 between the stepped sides, the concrete portion and the cap 4 are easily realized and distinguished from each other when concrete is deposited, so that concrete can be placed in a specific area. In addition, this serves to make good finish edges of concrete after the cap is removed from the capping member.

FIG. 2 shows the condition under which the deposit of concrete is finished. Under this condition concrete is hardened and after a predetermined period of time has passed, the cap 4 is removed from the capping member 2 as shown in FIG. 3. At this time a stepped portion 7 is formed by the top surface of two sides of the capping member and the sides of the concrete floor. FIG. 4 shows another condition under which the channel 3 of the capping member 2 is filled up with asphalt 9 or the like. Asphalt 9 or the like fills above the stepped portions 7, so that water is prevented from permeating between the capping member 2 and concrete as often observed in conventional joints. In addition, the top ends of both sides of the capping member 2 are not exposed above the surface of the concrete floor, so that the finished concrete floor is not spoiled.

Further, since the plate 1 is made of soft material such as foamed styrol and the partition 2*a* of the capping member 2 is corrugated, cracking in the concrete floor is prevented even if concrete expands and contracts. When a water-proof material such as butyl rubber is arranged on the stepped portion 2*b* of the capping member 2, the water-proofness of the joint is enhanced further.

Since the joint of the present invention has such arrangement and function as described above, it is easily handled, extremely suitable for use as a joint and extremely useful as a horizontal level at the time of concrete deposition.

FIGS. 5 through 8 show other examples of the joint in which the connection between the capping member 2 and the cap 4 is different from one another. In the example of the joint shown in FIG. 6, an adhesive agent 10 such as butyl rubber is arranged in the outer stepped portions of the capping member 2. The reason why the adhesive agent is arranged is that the capping member is prevented from separating from the concrete when concrete contracts as it hardens.

Other examples of the joint in which the adhesive agent is arranged are shown in FIGS. 9 through 16. The example shown in FIG. 9 has the capping member 2 but has no cap, different from the above-mentioned examples. The adhesive agent 10 is arranged on the surface of a soft material 11 which fills the outer recesses of the capping member 2. In the example shown in FIG. 10, the capping member 2 is provided with a hollow portion 12. FIGS. 11 through 18 show other examples of the joint in which the adhesive agent 10 is sandwiched between the capping member 2 and the cap 4. The partition of the capping member 2 is formed in a variety of shapes, which are all intended to reinforce the capping member 2, add elasticity to the capping member 2, reduce the volume of the adhesive agent to be used, and prevent the adhesive agent 10 from being squeezed out above the surface of the concrete floor due to the pressure caused when concrete expands. The example shown in FIG. 18 is intended to prevent the capping member 2 and the cap 4 from separating from the adhesive agent 10.

Examples of the joints shown in FIGS. 19 through 23 are suitable for preventing the joints from separating from concrete. The examples of the joints already described above can absorb the expansion of concrete, but do not satisfactorily follow the contraction of concrete and therefore tend to separate from concrete at the portion where the joints contact concrete. This tendency depends on the minuteness of concrete deposition and the mixing rate of concrete. However, there was in the past an instance in which a space wider than 4 millimters was caused at each side of the joint. In order to overcome this problem, the already-described examples of the joint have projections formed on the outer surface of the sides of the capping member or the adhesive agent such as butyl rubber arranged on the sides of the capping member. However, since these examples are constructed such that the joints, particularly the capping members themselves can not follow contraction of concrete, the projections and the adhesive agents are not enough to satisfactorily meet the object of enhancing the connection between the joints and concrete. Namely, since these examples do not have a construction where the width of the joint is freely changeable in response to contraction of concrete, cases are often observed where soil, sand or the like get into a space between the joint and concrete, so that the joint is broken by freezing of water that enters the the space. FIG. 19 is an isometric view showing an example of the joint considering the above mentioned problem. The capping member 2 is divided into two halves, which are slidably connected by means of a plate 13. Namely, the plate 13 is loosely inserted into each recesses formed by upper and lower plates 2*d* and 2*e*. It is preferable that the plate 13 is fitted into the recess leaving a space at each side of the recess. This is intended to absorb the expansion of concrete when the joint is pressed by the expansion of concrete. Accordingly, the space left at the side the of recess is not needed when the plate 13 is formed of an elastic material or the plate 13 has a loop formed at the center thereof to provide elasticity. The connecting strength between the plate 13 and the capping member 2 may be in such a degree that the joint body 1 does not easily fall off from the capping member. The connecting strength may be weaker when the joint body 1 is connected to halves of the capping member 2 by means of some agent. Numeral 15 represents projections to enhance the connection between the capping member 2 and concrete, the projections being held in hardened concrete. Numeral 16 denotes other projections useful for positioning the capping member 2 on the joint body 1. The projections 16 are not necessarily needed.

FIG. 20 is a sectional view showing another example of the joint, which is different from the example shown in FIG. 19 in that the halves of the capping member 2 are connected to each other by means of a connecting member 17 which is formed by extending and curving from the projections 16 shown in FIG. 19. This connecting member 17 may be formed separately and then attached to the ends of the projection 16. It is preferable that the connecting member 17 is made slightly thinner or of a soft material because elasticity is needed to the connecting member 17. Another difference between the examples shown in FIGS. 19 and 20 is that the opposite ends of the upper plate 2*d* are tapered and the other ends thereof are provided with erected projections to form a recess on the surface of the upper plates 2*d*. This is intended to make the joint exposed from concrete and to allow a tape to adhere to the recessed surface of the upper plates to display the position of the joint.

FIG. 21 is a sectional view showing the other example of the joint, which is different from the example shown in FIG. 19 in that through holes 18*a* and 18*b* are arranged in the center of the plate 13 and the sides of the capping member 2, respectively. It is preferable that the through holes 18*b* are trapezoidal in section, but it is not necessary that they be circular. Into each of the through holes 18*b* is fitted a plug 19 shown in FIG. 22. When the tape is attached to the upper surface of the capping member 2, no plug is necessary to each of the through holes 18*a*. After the joint is arranged on roughly deposited concrete, an adhesive agent is poured into the capping member 2 through these holes 18*a* and flows out through holes 18*b* to fill between the joint and concrete. The plug 19 serves to prevent concrete from entering into the hollow portion of the capping member at the time of arranging the joints and is forced out of the through holes 18*b* by the internal pressure of the adhesive agent poured into the capping member to thereby form a path through which the adhesive agent flows outside the capping member.

The examples of the joint shown in FIGS. 19 through 21 may have adhesive agent such as butyl rubber arranged in the recesses formed on both sides of the capping member.

FIG. 23 is a sectional view of a joint which is used as a wall joint. This example is different from other ones in the provision of means 20, 20*a*, 20*b* for fixing the joint to a temporary frame 22 and a slant plate 21 for preventing rainwater from entering in between the joint and concrete. Namely, fixing plates 20*a* extend obliquely from both sides of the top of the capping member 2 and the slant plate 21 further extends in an opposite direction from the upper fixing plate 20*a*. The joint is attached to the temporary frame 22 in such a way that the fixing means 20*a* of the joint is fitted onto a mounting member 23 which is fixed as shown in FIG. 23 to engage concave portions with convex portions 20*b*. After concrete deposition, the temporary frame 22 and the fixing means 20 are removed.

The joint of the present invention can be used as a wall joint by adding means for fixing the joint to the temporary frame, as described above.

FIG. 24 shows an example of the joint in which the caps 4 shown in FIGS. 11 through 18 are combined with the conception disclosed in the example of the joint shown in FIG. 19. In this example of the joint shown in FIG. 24, the cap 4 comprises two half caps with the plate 13 interposed therebetween to be able to move in the lateral direction to follow the adhesive agent 10 which is laterally stretched due to the contraction of concrete. Therefore, the surface of the adhesive agent is not exposed between the cap 4 and concrete in the example of the joint shown in FIG. 25 in which the cap comprises a single unit.

There will be now described examples of the joint suitable for exchanging or useful for repairing the broken or failed joint. There will be also described a repairing manner using these examples of the joint. The examples of the joint shown in FIGS. 21 and 26 are most suitable for repairing or exchanging the broken or failed joint. In the case of these examples of the joint, halves of the capping member 2 are connected to each other by the plate 13, and these halves of the capping member 2 and the plate 13 are provided with the through holes 18*a*, 18*b* and 19*a*, 19*b*, respectively. The downwardly extending sides between which the joint body 1 is held may be provided as shown in FIG. 21 or may not be provided as shown in FIG. 26. It is preferable that the connection between the halves of the capping member 2 and the plate 13 is relatively so loose that the halves of the capping member 2 are not easily separated from the plate 13. The through holes 19*a* and 19*b* may be previously formed or may be formed by a drill at the time of the repairing operation.

FIGS. 27 through 29 show how the repairing operation is carried out using the above-mentioned examples of the joint. The broken or failed joint which is shown in dotted lines in FIG. 27 must be removed. FIG. 27 shows the condition under which the broken or failed joint was removed. In the conventional manner, concrete was cut off at the portions shown by arrows A in FIG. 27. This is because a space slightly wider than a new joint is needed to imbed and fix the joint. In the manner of the present invention, either concrete is cut off at the portions shown by arrows B, or the cap or plate is divided at the portion shown by an arrow C to thereby allow the joint to be drawn out of the space. When the joint is already separated from the concrete, it is possible to draw the joint out of the space without any cutting operation. Projections are often provided on the outer surfaces of both sides of the capping member to enhance the connection between the joint and concrete. However, in fact concrete often escapes from these contact surfaces when concrete contracts, so that it is possible to draw the joint out of the space only by dividing the cap or plate of the joint at the portion shown by the arrow C.

FIG. 28 is a sectional view showing the condition under which the example of the joint shown in FIG. 21 or 26 is positioned in the space shown in FIG. 27. The width of the joint is arranged slightly narrower than that of the space. Before the new joint is positioned in the space, it is necessary to check the embedded joint body 1. When the joint body 1 is broken or degraded, it is necessary to repair the joint body 1 or to imbed a new joint body instead. However, these repairs become unnecessary when the old joint body can be repaired by the adhesive agent poured as described below.

FIG. 29 is also a sectional view showing the condition under which the space is filled with the adhesive agent such as butyl rubber and asphalt. The adhesive agent is poured with pressure into the hollow portion of the capping member through the holes 19*a* and fills the hollow portion to move the halves of the capping member apart from each other, namely to widen the joint. At the same time a part of the adhesive agent is forced to pass the through holes 19*b* out of the capping member 2 to fill in between the capping member 2 and concrete. A proper tool may be employed to widen the halves of the capping member 2. When the filling operation is finished, the through holes 19*a* of the plate 13 are closed by means of proper plugs. It is preferable to press down the joint by a weight such as an iron plate in order to prevent the joint from moving upwardly above the surface of the concrete floor when the filling operation of the adhesive agent is being carried out.

The above has been referred to as the repairing operation of the joint used in the floor, but the repairing of the wall joint can also be carried out according to the process described above.

As apparent from the above, according to the joint repairing manner of the present invention, it is possible to reliably repair the joint by a simple operation without spoiling the appearance. Particularly, since no patch of mortar is seen around the repaired joint different from the conventional manner, the appearance of the repaired joint is improved and additionally there is no fear of cracks occurring in the patched mortar nor of the patched mortar falling in the surface of the concrete floor.

FIGS. 30 through 40 show leg members for fixing the above-mentioned joints. Two kinds of the leg member 6 are already shown in FIG. 1.

Figure 30:
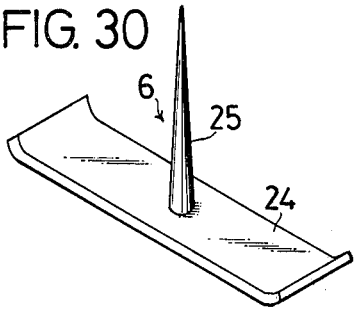
Figure 31:
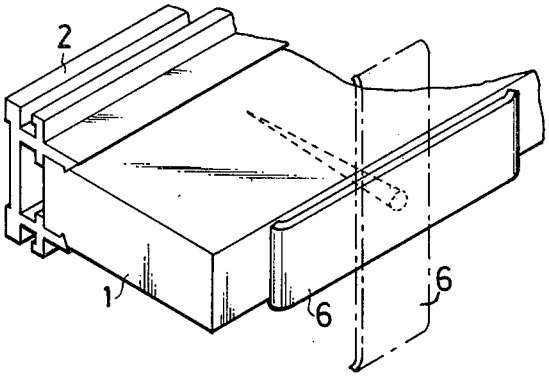

FIG. 30 is a perspective view showing another example of the leg member for fixing the joint. This leg member 6 comprises a base plate 24 and a conical attaching member 25 formed integrally with the base plate 24 and in the center thereof. This leg member is constructed of plastic and integrally formed, but the material of the leg member is not limited to plastics. As shown in FIG. 31, the leg member 6 is attached to the joint in such a manner that the attaching member 25 is stuck into the base of the joint body 1. Upon transportation of the joint, the base plate 24 is laid along the longitudinal direction of the joint body base. Upon use of the joint, the leg member 6 is slightly drawn from the joint body 1 and is situated on roughly deposited concrete floor, and then the leg memeber 6 is fixed with mortar on the floor as shown in dot-and dash line in FIG. 32. At this time, the base plate 24 is directed perpendicularly to the longitudinal direction of the joint body 1 as shown in dot-and-dash line in FIG. 31. The attaching member 25 may be threaded.

FIG. 33 is a sectional view showing another example of the leg member which is different from the one shown in FIG. 30 in that metal plates 24*a* are interposed in the base plate 24. The height of the joint can be adjusted by bending the metal plates 24*a*.

FIG. 34 is a sectional view showing an example of the leg member which is constructed of metal. The attaching member 25 is calked to the base plate 24, but may be welded to the base plate 24.

Figure 35:
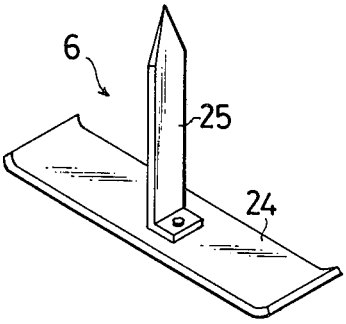

In the case of the example of the leg member shown in FIG. 35, the attaching member 25 is formed by a plate and calked at the base thereof to the base plate 24. The connection between the attaching member 25 and the base plate 24 is arranged slightly loosely so that the base plate 24 can be rotated as shown in FIG. 31. It is preferable to add a rib to the attaching member 25 to enhance the strength of the leg member.

Figure 36:
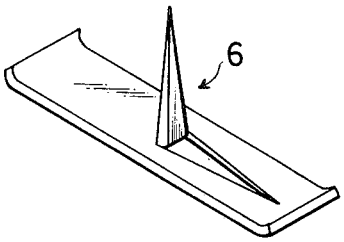
Figure 37:
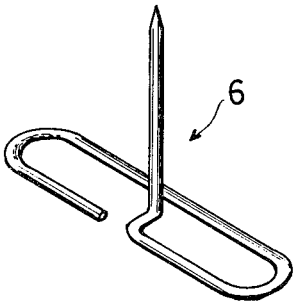

FIG. 36 is a perspective view showing an example of the leg member 6 which is formed by a pressing process, while FIG. 37 is also a perspective view showing an example of the leg member 6 which is formed by bending a metal wire.

The examples of the leg member formed as mentioned above have such advantages that they do not hinder the transportation of the joint, can be easily handled at the construction site, and extremely reduce failure in arranging the joint on roughly deposited concrete floor.

Figure 38:
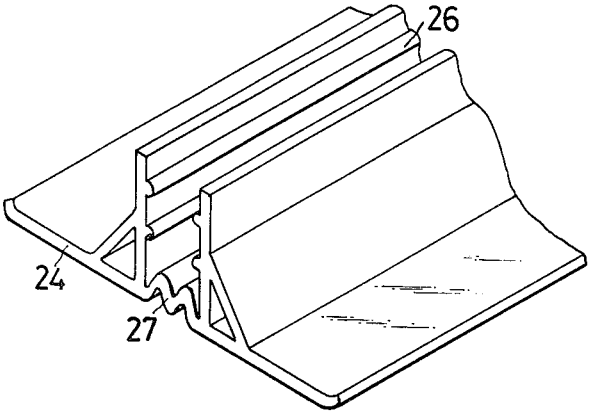
Figure 39:
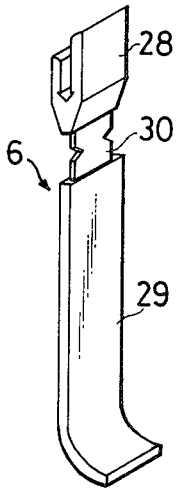

FIGS. 38 and 39 show other examples of the leg member for fixing the joint. In the example shown in FIG. 38, a pair of joint body holding portions 26 are formed in the center of the leg member and the base plates 24 are connected by a wave-formed connecting member 27. This connecting member 27 has a spring-like action and the opposing holding portions 26 are arranged to come closer as they rise upwardly, so that the joint body 1 can be firmly held between the holding portions allowing the height of the joint to be adjusted. The example shown in FIG. 39 comprises an attaching member 28 which is attached to the lower end of the capping member 2, a leg 29 and a metal connecting member 30 for connecting the attaching member 28 to the leg 29. The height of the joint can be adjusted by bending the metal connecting member 30.

FIGS. 40 through 45 show other examples of the leg member for fixing the joint. In the cases of previously described examples of the leg member, they must be fixed with mortar on the surface of roughly deposited concrete, after opening or closing their legs to adjust the joint level. When they are incompletely fixed, there is the danger that the joint will slide from the predetermined position at the time of the concrete deposition, or be bent at the center portion thereof. Mortar used to fix them must be prepared either in a construction site, or at a different place to be carried to the construction site. However, because a great amount of mortar is used and the mortar handling operation is carried out alongside the other operations, particularly in the case of constructing a building, inconvenience is often caused in the use of operation elevators, for example. Further, there is a danger that the joints will tend to be incompletely arranged, because the mortar handling operation is troublesome in the construction site.

The examples of the leg member shown in FIGS. 40 through 45 are intended to overcome the above-mentioned problems and to provide an easy and reliable manner for fixing the joint.

FIGS. 40 and 41 show a joint fixing means employed to attain the joint fixing manner of the present invention, the fixing means comprising a pair of trigonal prism blocks 31, and a connecting member 32 such as rod and lumber plate for connecting the blocks with a space 33 interposed therebetween, into which the joint body is to be fitted. The base of the blocks 31 may be formed flatly, but it is more preferable to cause the blocks to firmly adhere to the surface of the roughly deposited concrete by forming projections on the base of the blocks and interposing mortar between the base of the blocks and the surface of the roughly deposited concrete. When the blocks can not support the joint at a necessary level, joint supporting members 34 embedded on surfaces of the blocks 31 as shown in the figures are used. The supporting member 34 may be formed of a metal rod or plate, and the plate may or may not be provided with a rib.

Figure 42:
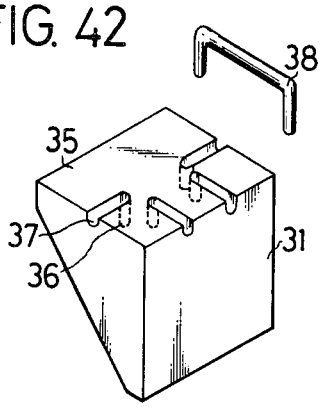

FIG. 42 is a perspective view showing another example of the blocks employed in the joint fixing manner of the present invention, a view of the block from the base thereof. This example of the blocks has a form basically similar to that of the blocks shown in FIG. 40. In FIG. 42, holes 36 and channels 37 are formed in the base of the blocks 31 and connecting members 38 made of a rod or a plate are fitted into the holes and channels to connect the blocks 31. The channels 37 serve to prevent the connecting members 38 from damaging the water-proof layer of asphalt laid on the surface of the roughly deposited concrete. When mortar is laid under the blocks 31, no channels 37 may be provided. As described with reference to the example of the blocks shown in FIGS. 40 and 41, it is also possible in the example of the blocks shown in FIG. 42 to use the joint supporting members 34. The joint supporting members 34 are previously embedded in the blocks 31, or are fitted into the holes provided in the outer surface of the blocks 31.

Figure 43:
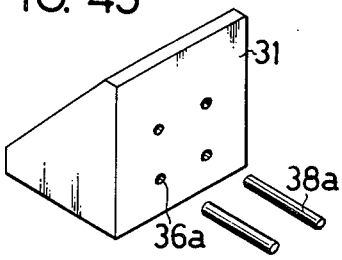

FIG. 43 shows a further example of the blocks employed in the joint fixing manner of the present invention. This example is characterized by members for connecting the blocks. Holes 36*a* are formed in the vertical surface of the blocks 31 and both ends of a connecting member 38*a* are inserted into the corresponding holes 36*a*, thus forming a pair of joint fixing blocks as shown in FIG. 40. In order to meet the space interposed between the blocks with the thickness of joint body, the connecting members may be provided with positioning marks, other displays or collars. Further, in order to enhance the connection between the blocks, the depth of the holes 36*a* may be adjusted, or both ends of each of the connecting members may be threaded or provided with a fixing mechanism as employed in anchor bolts.

FIG. 44 shows another example of the blocks employed in the joint fixing manner of the present invention. One of the blocks 31 is provided with a connecting member 39*a* attached to the base thereof and having a projection 39*b*, while the other is provided with a corresponding connecting member and a recess in the base thereof. Therefore, these two blocks are combined with each other to form a joint fixing means. The connecting member used in this example may be constructed of a material such as synthetic resin and a metal different from that of the blocks 31.

In the above-mentioned examples, the blocks 31 are formed using cement as a main material as in usual concrete blocks. However, the material of the blocks 31 is not necessarily limited to cement, and a variety of materials may be employed considering their strength, weight, ease of formation, manufacturing cost or the like.

The joint fixing manner of the present invention will be now described referring to FIG. 45. The joint fixing blocks 31 are arranged with a certain distance therebetween on the surface of roughly deposited concrete. It is preferable at this time to lay a little amount of mortar between the blocks and concrete to prevent the blocks 31 from sliding from the predetermined positions thereof at the time of concrete deposition. Two pairs of blocks are arranged at the place where the joints are crossed. The joint is inserted into the space 33 between the blocks adjusting the height of the joint level. The joint can be easily adjusted at the level by adding mortar or the like into the space 33 between the blocks. When the joint must be positioned so high that the upper portion of the joint tends to bend at the time of concrete deposition, the joint supporting members 34 are employed to support the upper portion of the joint as shown in FIG. 45.

As described above, the joint fixing manner of the present invention enables the joint to be firmly fixed by the heavy blocks, thus preventing the joint from sliding from the predetermined position thereof at the time of concrete deposition and from bending at the upper portion thereof. In addition, the joint fixing manner of the present invention makes it extremely easy to arrange the joints at the construction site, thus reducing difficulties in the joint arranging operation.

FIGS. 46 through 49 show examples of the joint connecting members 40*a* and 40*b*. The joint connecting member 40*a* shown in FIG. 46 is used in a case where the joints are connected to each other in a line as shown in FIG. 47, while another joint connecting member 40*b* is used in a case where the joints are connected to each other in a T-shape as shown in FIG. 49.

As is apparent from the above, the joint of the present invention can be provided at lower cost as compared with the conventional ones, can be easily arranged in a construction site and functions excellently. Particularly, the joint of the present invention serves to function as a level at the time of concrete deposition, thus making it extremely easy to deposit concrete.

What is claimed is:

1. A joint for use in a concrete deposit, comprising an elongated joint body made of soft material adapted to be placed into the concrete deposit for the purpose of separation, a capping assembly mounted on top of said joint body, said capping assembly including a capping member connected to said joint body and a cap detachably secured to said capping member, said capping member having a lower portion engaged with and located along the entire length of said joint body and an upper portion extending upwardly from said lower portion to thereby define a space therein along the joint body, said cap being dimensioned for covering the space of said upper portion to close the same, said cap being placed on the upper portion of said capping member when concrete is hardened, and leg members removably attached to said joint body for supporting the joint, said leg members having means to vertically adjust the height of said joint.

2. A joint for use in concrete deposit according to claim 1, in which said upper portion of the capping member of the capping assembly comprises two side walls extending upwardly from the lower portion and two projections extending inwardly from the respective side walls in the longitudinal direction of the capping member, said space being defined between the two side walls.

3. A joint for use in concrete deposit according to claim 2, in which said cap of the capping assembly comprises a top plate and two side plates connected to longitudinal edges of said top plate, said side plates having concavities at respective lower portions thereof to be detachably engaged with said projections of said upper portion of the capping member.

4. A joint for use in a concrete deposit according to claim 3, further comprising recesses situated outside respective side walls of said upper portion, said recesses extending in the longitudinal direction of said joint body, and adhesive agent provided in said recesses for sealingly connecting the joint and the concrete when hardened.

5. A joint for use in a concrete deposit according to claim 1, in which said leg member comprises a supporting plate to be disposed on a support surface and a connecting rod attached to the supporting plate at one end, the other end of the connecting rod having a sharp edge adapted to be inserted into the joint body so that the location of the leg member and the height of the joint from the support surface can be freely changed.

6. A joint for use in a concrete deposit according to claim 5, in which said supporting plate of the leg member includes intermediate members therein for bending the supporting plate thereat to adjust the height of the joint.

7. A joint for use in a concrete deposit according to claim 1, in which said leg member comprises an attaching member connected to a lower end of the capping member, a leg to be placed on a support surface and a connecting metal segment for connecting the attaching member to the leg, said connecting metal segment being bendable.

* * * * *